US011779943B1

(12) United States Patent
Thomas, Jr. et al.

(10) Patent No.: US 11,779,943 B1
(45) Date of Patent: Oct. 10, 2023

(54) NOZZLE ATTACHMENT FOR INCREASING THE OUTPUT FLUX OF A FLUID OUTLET, AND METHODS FOR ITS USE

(71) Applicants: William K. Thomas, Jr., Marion, MA (US); Paul Contente, Bristol, RI (US)

(72) Inventors: William K. Thomas, Jr., Marion, MA (US); Paul Contente, Bristol, RI (US)

( * ) Notice: Subject to any disclaimer, the term of this patent is extended or adjusted under 35 U.S.C. 154(b) by 169 days.

(21) Appl. No.: 17/518,827

(22) Filed: Nov. 4, 2021

Related U.S. Application Data

(60) Provisional application No. 63/191,944, filed on May 22, 2021.

(51) Int. Cl.
*B05B 1/34* (2006.01)
*B05B 1/00* (2006.01)

(52) U.S. Cl.
CPC ..... *B05B 1/34* (2013.01); *B05B 1/005* (2013.01)

(58) Field of Classification Search
CPC ..... B05B 1/34; B05B 1/005
USPC ... 239/11, 419.5, 589, 590, 590.5, 600, 601, 239/DIG. 21, DIG. 22; 15/405, 415.1
See application file for complete search history.

(56) References Cited

U.S. PATENT DOCUMENTS 2,320,964 A * 6/1943 Yates ..... B08B 5/02 15/405
2,645,528 A * 7/1953 Thorsen ..... B05B 1/005 239/430
3,263,934 A * 8/1966 Hope, Jr. ..... B05B 1/005 239/601
3,647,142 A * 3/1972 Drude ..... B05B 1/005 239/DIG. 22
4,060,874 A * 12/1977 Furutsutsumi ..... B08B 5/02 239/DIG. 22
8,178,990 B2 5/2012 Freda
9,897,111 B2 2/2018 Mornan et al.
2014/0299672 A1* 10/2014 Gopalan ..... E01H 1/0809 239/11

FOREIGN PATENT DOCUMENTS

CN 204942111 1/2016

* cited by examiner

*Primary Examiner* — Steven J Ganey

(74) *Attorney, Agent, or Firm* — JOHN RIZVI, P.A.; John Rizi

(57) ABSTRACT

A nozzle attachment and method for its use is provided. The nozzle attachment can be affixed to a fluid outlet. The nozzle attachment is constructed and arranged to increase the total output flow, flux, of the fluid outlet by using the high velocity directional fluid flow from the outlet to create a pressure differential between the flow and the surrounding medium, thereby causing fluid particles from the surrounding medium to be drawn into the fluid flow. The nozzle attachment comprises a nozzle attachment fixation element, a funnel element, and a frame connector extending between the nozzle attachment fixation element and the funnel element. The nozzle attachment has many applications and uses.

20 Claims, 3 Drawing Sheets

NOZZLE ATTACHMENT FOR INCREASING THE OUTPUT FLUX OF A FLUID OUTLET, AND METHODS FOR ITS USE

CROSS-REFERENCE TO RELATED APPLICATIONS

This application claims the benefit of U.S. Provisional Patent Application No. 63/191,944, filed on May 22, 2021, which is incorporated by reference herein in its entirety.

FIELD OF THE INVENTION

The present invention relates generally to nozzles for expelling fluids, and more particularly, to a nozzle attachment capable of increasing the total output flux of a directional fluid outlet to which it is attached.

BACKGROUND OF THE INVENTION

In the modern world, high velocity fluid outlets are ubiquitous. Examples of the uses of high velocity fluid outlets include but are not limited to air-based outlets on apparatuses such as hair dryers, leaf blowers, ventilation ducts, and various water-based outlets such as outboard motors and other marine vehicle propulsion systems.

It is often desirable to have as high a flux capacity as possible for such outlets. However, the output is generally limited by the energy consumption requirements of the source generating the propulsion. Though solutions exist for focusing and directing the flow of such high velocity fluid outlets, such solutions require spending additional energy to increase the overall fluid output volume per second, flux.

For example, induction nozzles exist which attempt to increase the throughput of fluid from a fan outlet of a building exhaust or duct. Such designs are specifically intended for fan/exhaust outlets, and are not capable of working with high throughput jet streams such as leaf blower outlets, partially due to the smaller air inlets at the sides preventing a low-pressure suction trap.

Nozzle attachments also exist which are designed with the goal of increasing throughput of an outlet, but attempt to accomplish this goal in conjunction with additional machines device to propel or draw the fluid.

For example, a nozzle attachment with a fan-like propeller at the base of the nozzle has been proposed. However, such a nozzle attachment has no intakes on the sides for increasing total fluid flow, and requires the nozzle to be in contact with a wind powered turbine. This is not only complicated but may also be ineffective.

Another example of a nozzle which attempts to increase the capacity of an outlet is associated with an added vacuum pump. The additional vacuum pump does not offer an effective solution. It may be expensive to run a vacuum pump. Further, use of a vacuum pump may become complicated by need for maintenance and repair.

Simply put, the only existing ways to increase output from a nozzle are associated with an additional device or machine which requires an energy source.

Ideally, it would be extremely useful to have a way of increasing the overall fluid output volume from a nozzle per second, flux, without spending additional energy. However, no solution exists which is capable of resolving this need.

Accordingly, there is need for a solution to at least one of the aforementioned problems. For instance, there is an established need for a device capable of increasing the total output flow, flux, of the fluid outlet of a nozzle. There is a further need for such a device which is versatile and capable of use with multiple types of nozzles used for multiple applications and purposes. There is an additional need for such a device that may be removably attached to any nozzle, and may be easily installed and removed.

SUMMARY OF THE INVENTION

The present invention is directed to a nozzle attachment or adapter which is constructed and arranged to be permanently fixed or removably connected to a fluid outlet. The nozzle attachment is shaped to increase the total output flow, flux, of the fluid outlet. The nozzle attachment is configured to accomplish this increase by using the high velocity directional fluid flow from the fluid outlet to create a pressure differential between the flow and the surrounding medium, thereby causing fluid particles from the surrounding medium to be drawn into the fluid flow. The nozzle attachment has many applications and uses, as described more fully hereinbelow.

In a first implementation of the invention, the present invention provides a nozzle attachment for increasing the flux of a fluid outlet having a given diameter, the fluid outlet being configured to emit a high-velocity fluid along a given axis. The nozzle attachment comprises a nozzle attachment fixation element for securing the nozzle attachment to the fluid outlet. The nozzle attachment further comprises a funnel element connected to the nozzle attachment. The funnel element has a first end proximal to the attachment means and a second end distal from the nozzle attachment fixation element. The funnel element is tapered such that the diameter of its first end is greater than the diameter of its second end. The first end and second end of the funnel element have a greater diameter than the fluid outlet to which the nozzle attachment is secured.

In a further aspect, the nozzle attachment further comprises a frame connector for holding the nozzle attachment fixation element and the funnel element together. The frame connector forms one or more openings such that a high velocity fluid stream travelling along the given axis causes a pressure differential at the openings, thereby causing additional fluid to be drawn into the fluid stream.

In another aspect, the nozzle attachment fixation element comprises a clamp configured to enclose a structure comprising a fluid outlet. The clamp may be any suitable clamp. A nonlimiting example of a clamp is a c-shaped clamp.

In a second implementation, the nozzle attachment further comprises a fluid flow smoothing element mounted within the funnel element for regulating or evening the velocity distribution of fluid particles passing through the funnel element.

In one aspect, the fluid flow smoothing element may comprise a teardrop structure mounted to an internal surface of the funnel element by a bracket and positioned in the center of the funnel element with the point of the teardrop structure pointed along the axis.

In another aspect, the nozzle attachment further comprises one or more air foils mounted within the funnel element for controlling the direction of flow of fluid particles passing through the funnel element.

In yet another aspect, the one or more air foils may be configured to cause a fluid flow passing through the funnel element to rotate and from a vortex flow.

According to another aspect of the present disclosure, there is provided a use of the nozzle attachment according to any one of the above-described embodiments to increase the output capacity of a fluid outlet.

In one aspect, the present invention provides a method for increasing the output capacity of a fluid outlet, comprising the steps of providing a nozzle attachment as disclosed herein, and installing the nozzle attachment to a fluid outlet. The fluid outlet may be any suitable fluid outlet.

In one aspect, the fluid outlet may be the fluid outlet of a leaf blower.

In another aspect, the fluid outlet may be the fluid outlet of a motor, drive, or thruster of a marine vehicle. The fluid outlet may be part of an outboard motor. The fluid outlet may be part of a water jet drive. The fluid outlet may be part of a bow thruster.

In a further aspect, the fluid outlet may comprise a fluid outlet of a fan directed into a ventilation airway. The fluid outlet may be constructed and arranged to improve ventilation flow of the fan. The fluid outlet may be constructed and arranged to provide outside ventilation air for an air handling unit in a building.

In one aspect, the fluid outlet may be part of a marine salvage "mailbox".

In another aspect, the fluid outlet may be part of an open loop concentrated solar panel (CSP) desalination or water purification system and the fluid outlet is constructed and arranged to provide condensing of steam.

In a further aspect, the fluid outlet may be used for drying cars.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
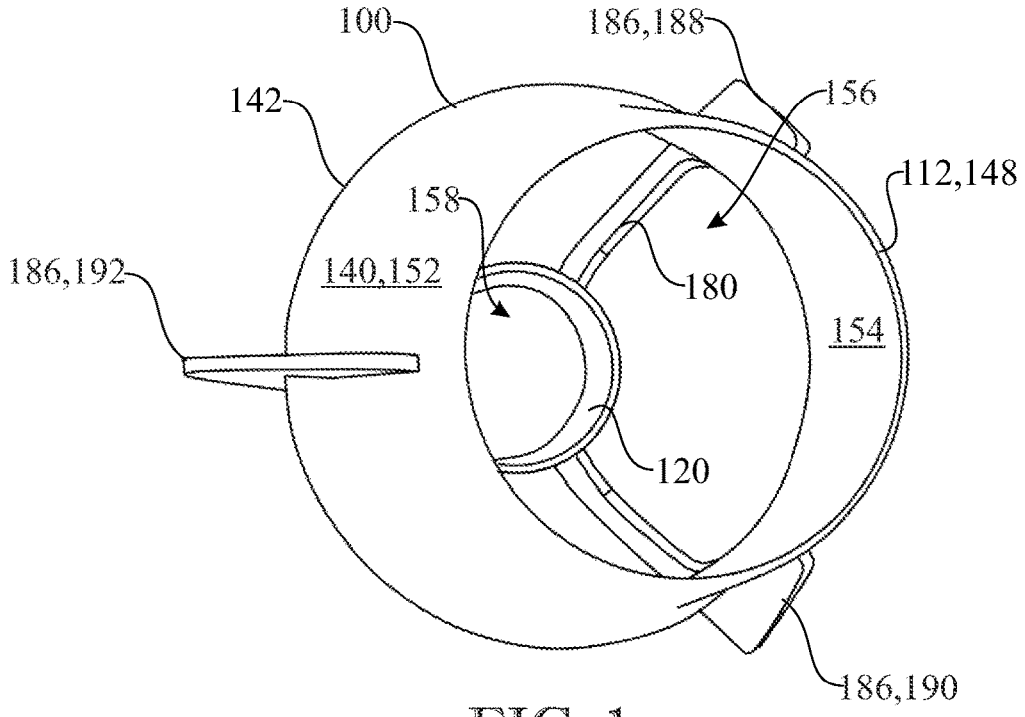
FIG. 1 presents a frontal isometric view of a nozzle attachment in accordance with a first illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

Shown throughout the figures, the present invention is directed toward a nozzle attachment or adapter for increasing the total fluid output of a fluid outlet by creating a pressure differential in a set of openings between the fluid outlet and a tapered funnel element of the nozzle attachment.

Figure 2:
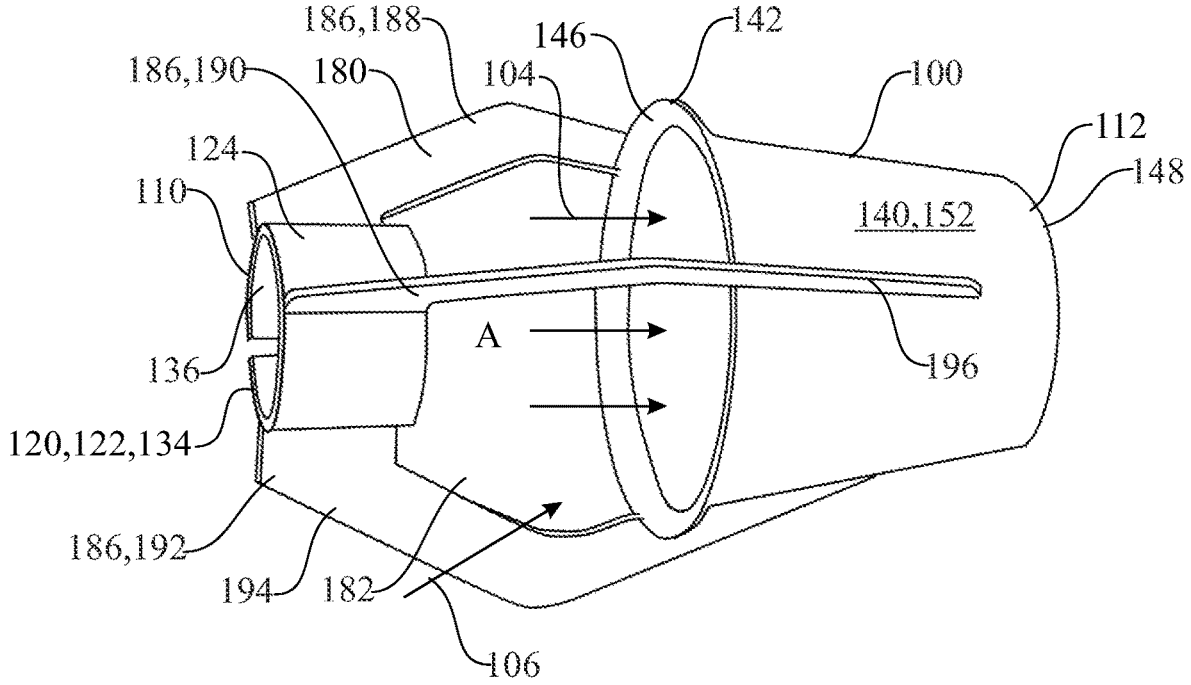
FIG. 2 illustrates a side isometric view of the nozzle attachment illustrated in claim 1.

Referring initially to FIG. 1 and FIG. 2, a nozzle attachment 100 capable of increasing the total output flux of a directional fluid outlet to which it is attached, is illustrated in accordance with a first exemplary embodiment of the present invention.

The nozzle attachment 100 may be removably secured or permanently fixed to a fluid outlet that is configured to emit a high-velocity fluid stream along a fluid outlet axis, for increasing the flux of the fluid outlet, the fluid outlet having a fluid outlet exterior surface, a fluid outlet circumference and a fluid outlet diameter. Point A at FIG. 2, indicates the position of the fluid outlet. Arrows 104 indicate the direction of the high velocity fluid stream along the fluid outlet axis.

The nozzle attachment 100 has a nozzle attachment proximal end 110 and a nozzle attachment distal end 112. The nozzle attachment comprises a nozzle attachment fixation element 120 and a funnel element 140. The nozzle attachment fixation element 120 may be any suitable fixation means. The nozzle attachment fixation element is constructed and arranged for removable securement to the fluid outlet exterior surface around the fluid outlet circumference, to removably secure the nozzle attachment to the fluid outlet.

In an exemplary embodiment, the nozzle attachment fixation element 120 may be a clamp mechanism. The clamp mechanism may be a clamp 122 that may be secured to a fluid outlet to attach the nozzle attachment 100 to the fluid outlet. The clamp 122 has an exterior surface 124 and an interior surface 126. The clamp 122 may be secured to a pipe or exhaust such that the fluid outlet of the pipe or exhaust which is configured to emit a high velocity fluid, is positioned facing into the funnel element 140 of the nozzle attachment 100. Other fixation means may be used depending on the type of outlet to which the nozzle attachment 100 is affixed. In some embodiments, the clamp 122 is a c-shaped clamp 134 which has a circular shape, and has an inner circumference 136 and an outer circumference 138.

As seen at FIG. 2, in an exemplary embodiment, the funnel element 140 has a frusto-conical shape. The funnel element 140 comprises a funnel element first end 142 having a funnel element first end diameter 144, and a funnel element second end 148 having a funnel element second end diameter 150. The funnel element 140 has a funnel element exterior surface 152, a funnel element interior surface 154 and a funnel element interior portion 156 which has a funnel element central interior portion 158. The funnel element first end 142 is proximal to the nozzle attachment fixation element 120. The funnel element second end 148 is distal from the nozzle attachment fixation element 120, and the position A (as seen at FIG. 2) where the fluid outlet will be positioned. The funnel element second end 148 defines the nozzle attachment distal end 112. The funnel element 140 is tapered such that the funnel element first end diameter 144 is greater than the funnel element second end diameter 150. Both the funnel element first end diameter 144 and the funnel element second end diameter 150 are greater than the fluid outlet diameter of the fluid outlet to which the nozzle attachment 100 is secured, to ensure that the fluid stream emitted therefrom is fully captured and is not constricted. In some embodiments, the funnel element 140 further comprises a proximal end flange 146 constructed and arranged to assist in fully capturing the fluid stream.

The nozzle attachment 100 further comprises a frame connector 180 constructed and arranged to extend between the nozzle attachment fixation element 120 and the funnel element 140, and to rigidly hold the nozzle attachment fixation element 120 and the funnel element 140 together. The frame connector 180 is configured to form a plurality of openings 182 between the fluid outlet and the funnel element 140, such that the high velocity fluid stream travelling along the fluid outlet axis (see arrows 104 at FIG. 2) causes a pressure differential at the plurality of openings 182, thereby causing additional fluid to be drawn into the high velocity fluid stream traveling along fluid outlet axis, depicted by arrows 104. The direction of the fluid being drawn into the high velocity fluid stream is shown at arrow 106.

In an exemplary embodiment, the frame connector 180 comprises a plurality of rigid bars 186. Each bar of said plurality of rigid bars 186 extends from the clamp outer circumference 138 to the funnel element exterior surface 152, having a rigid bar proximal end 194 fixed to the clamp 122 and a rigid bar distal end 196 fixed to the funnel element 140. In some embodiments, the frame connector 180 comprises a first rigid bar 188, a second rigid bar 190, and a third rigid bar 192. The rigid bars 188,190,192 are constructed and arranged to securely retaining the clamp 122 to the funnel element 140.

This configuration forms a plurality of openings 182 about the circumference of the position where the fluid outlet will be positioned (see A, FIG. 2), meaning that fluid from the surrounding medium, be it air, water, or another gas or fluid, will be free to be absorbed into the high velocity fluid stream emitted from the outlet before passing through the funnel element 140. This will occur due to the pressure differential created by the high velocity fluid stream, the high pressure of the stream generating a lower pressure in the surrounding medium, sucking further medium particles into the funnel element 140. This is represented by flow arrow 106 at FIG. 2.

This effectively means that a fluid flow having a first flux being emitted from an outlet at the point between the nozzle attachment fixation element 120 and the funnel element 140 will be changed into a fluid flow having a second, higher flux at the point it is passed through the funnel element 140.

This increase of total fluid flow without additional energy usage has a variety of applications, and enables energy savings by having devices to which the nozzle attachment 100 is affixed, produce the same amount of force and fluid output with a lower emission from the source output.

Applications include but are not limited to:

1) Leaf Blowers;
2) Outboard Motors;
3) Water Jet Drives;
4) Bow Thrusters;
5) "Mailboxes" for Marine Salvage;
6) Condensing steam in open loop Concentrated Solar Panel (CSP) Desalination/Water purification systems;
7) Fan ventilation flow improvement;
8) Outside Ventilation Air for Air Handling Units in buildings; and
9) Methods of drying cars.

Naturally, the shape, size, and configuration of the nozzle attachment 100 may vary depending on the intended application due to considerations of force, medium, and fluid outlet shape.

No matter the application, it is important that minimal obstructions are formed between the point of emission of the fluid stream from the source outlet and the surrounding medium in the space between the nozzle attachment fixation element 120 and the funnel element 140.

Figure 3:
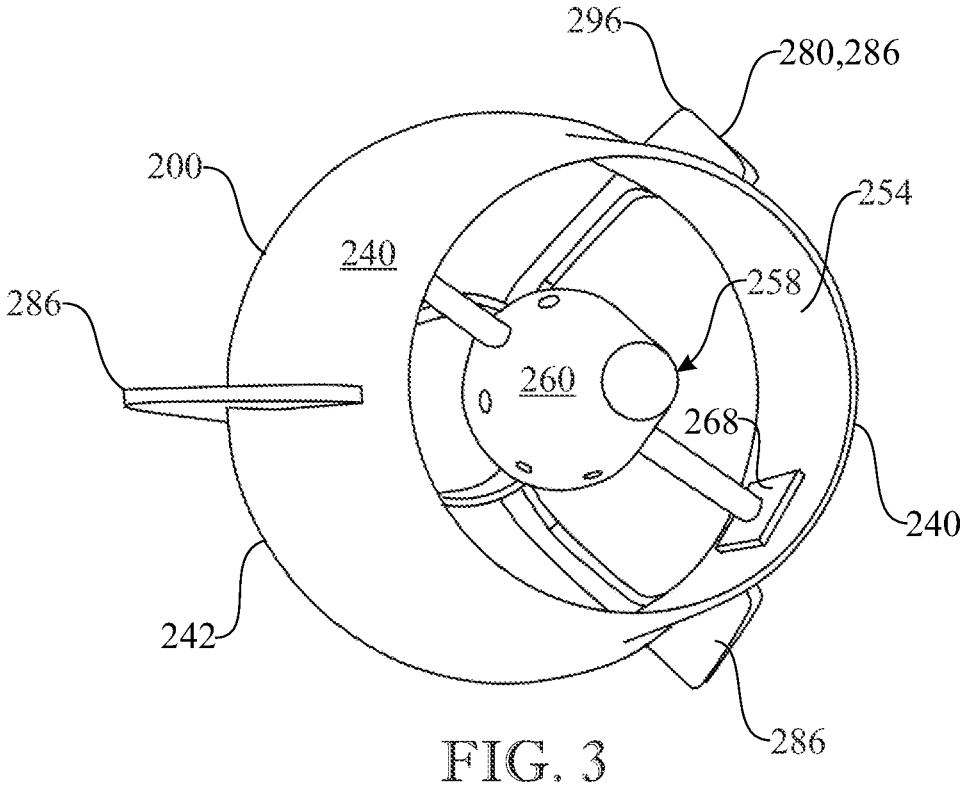
FIG. 3 illustrates a frontal isometric view of a nozzle attachment in accordance with a second illustrative embodiment of the present invention.
Figure 4:
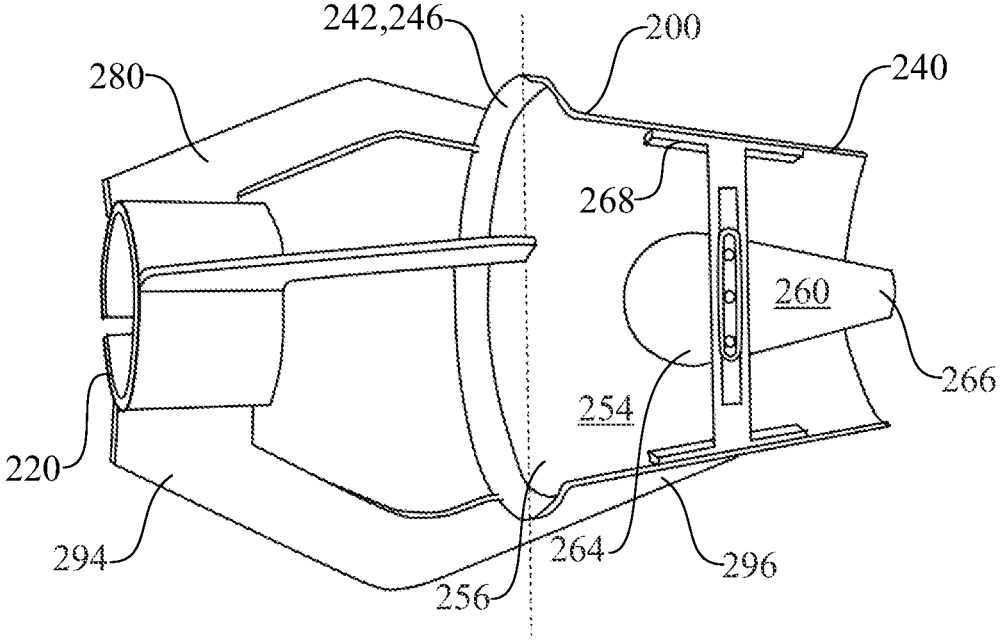
FIG. 4 illustrates a nozzle attachment as in FIG. 3, with a partial cross-sectional view of the funnel element thereof.

Various structures and mechanisms can be provided within the funnel element for controlling the higher volume flow passing through it. Referring next to FIGS. 3-4, a nozzle attachment 200 is shown in accordance with a second illustrative embodiment of the invention. Reference numerals which correspond to like elements of the nozzle attachment 100 heretofore described with respect to FIGS. 1-2 are designated by the same reference numerals in the 200-299 series in FIGS. 1-2. As seen at FIG. 3, an isometric view and FIG. 4, a cut-away view (with a portion of the nozzle attachment 200 to the right of the dashed line removed), nozzle attachment 200 has a configuration that is similar to the nozzle attachment 100 shown at FIGS. 1-2. The nozzle attachment 200 further comprises a fluid flow smoothing element 260 mounted in the funnel element interior portion 256. The fluid flow smoothing element 260 is constructed and arranged for regulating a velocity distribution of a plurality of fluid particles of the high velocity fluid stream passing through the funnel element 140.

In an exemplary embodiment, the fluid flow smoothing element 260 comprises a teardrop structure 262 having a proximal rounded portion 264 and a distal pointed portion 266. The teardrop structure 262 is mounted to the funnel element interior surface 254 by a mounting bracket 268 and positioned in a funnel element central interior portion 258 with the distal pointed portion 266 aligned with the fluid outlet axis. The shape and the axial placement of the teardrop structure 262 causes fluid passing through the funnel element 240 to have a more even velocity distribution.

Alternative similar structures can be installed to achieve different effects such as controlling the direction of the fluid flow. For example, multiple curved air foils may be placed along the inner walls of the funnel element to create a vortex flow. In some embodiments, the nozzle attachment 200 further comprises at least one air foil 270 (not shown) mounted in the funnel element interior portion 256, the at least one air foil being constructed and arranged for controlling the direction of flow of a fluid passing through the funnel element. The at least one air foil 270 (not shown) is configured to cause a fluid flowing through the funnel element 240 to rotate and from a vortex flow. The at least one air foil 270 may comprise a plurality of air foils.

Figure 5:
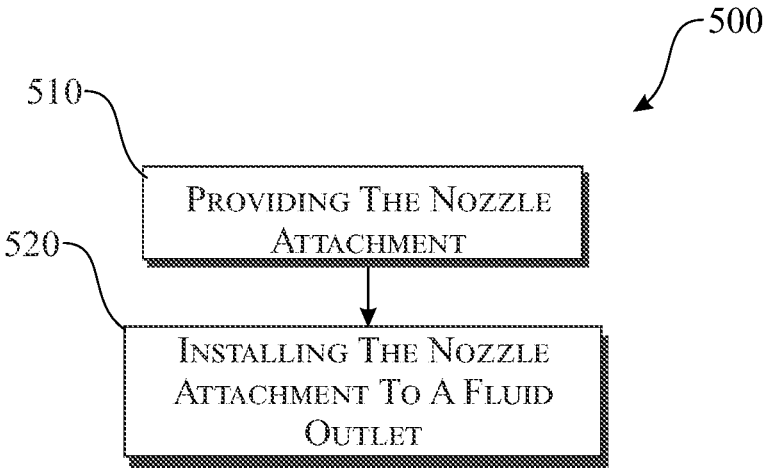
FIG. 5 provides a flow chart illustrating a method in accordance with an exemplary embodiment of the present invention.
Figure 6:
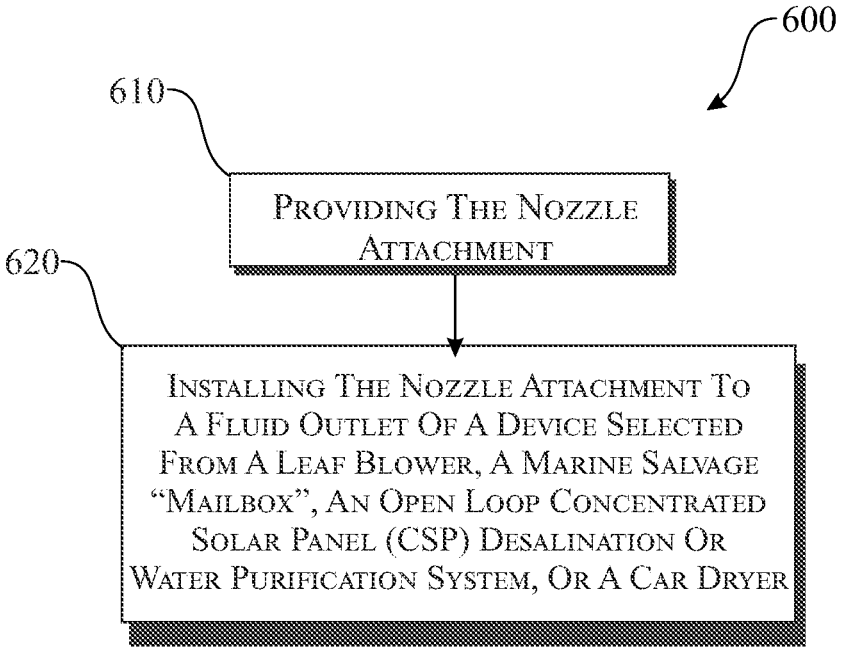
FIG. 6 provides a flow chart illustrating a method in accordance with an exemplary embodiment of the present invention.

Referring now to FIGS. 5-6, a method for increasing the output capacity of a fluid outlet is described.

With reference to FIG. 5, the method for increasing the output capacity of a fluid outlet 500 comprises the steps of 510 providing a nozzle attachment as described hereinabove, and 520 installing the nozzle attachment to a fluid outlet.

With reference to FIG. 6, the method 600 comprises the steps of 610 providing a nozzle attachment as described hereinabove, and 620 installing the nozzle attachment to a fluid outlet of a device selected from a leaf blower, a marine vehicle, a ventilation system, a marine salvage "mailbox", an open loop concentrated solar panel (CSP) desalination or water purification system, or a car dryer.

The marine vehicle fluid outlet may be part of a motor, a drive, or a thruster. The fluid outlet may be part of an outboard motor, a water jet drive, or a bow thruster.

The fluid outlet may be part of a fan directed into a ventilation airway. The fluid outlet may be constructed and arranged to improve ventilation flow of the fan.

The fluid outlet may be part of an open loop concentrated solar panel (CSP) desalination or water purification system. The fluid outlet may be constructed and arranged to provide condensing of steam.

The disclosed embodiments are illustrative, not restrictive. While specific configurations of the nozzle attachment and uses thereof have been described in a specific manner referring to the illustrated embodiments, it is understood that the present invention can be applied to a wide variety of solutions which fit within the scope and spirit of the claims. There are many alternative ways of implementing the invention.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A nozzle attachment for removable securement to a fluid outlet configured to emit a high-velocity fluid stream along a fluid outlet axis, for increasing a flux of the fluid outlet, the fluid outlet having a fluid outlet exterior surface, a fluid outlet circumference and a fluid outlet diameter, the nozzle attachment having a proximal end and a distal end, the nozzle attachment further comprising:

a nozzle attachment fixation element constructed and arranged for removable securement to the fluid outlet exterior surface around the fluid outlet circumference, to removably secure the nozzle attachment to the fluid outlet;

a funnel element having a frusto-conical shape, the funnel element comprising a funnel element first end having a funnel element first end diameter, and a funnel element second end having a funnel element second end diameter, wherein the funnel element first end is proximal to the nozzle attachment fixation element, wherein the funnel element second end is distal from the nozzle attachment fixation element, wherein the funnel element distal end defines the nozzle attachment distal end, wherein the funnel element is tapered such that the funnel element first end diameter is greater than the funnel element second end diameter, and wherein both the funnel element first end diameter and the funnel element second end diameter are greater than the fluid outlet diameter of the fluid outlet to which the nozzle attachment is secured; and a frame connector constructed and arranged to extend between nozzle attachment fixation element and the funnel element, and hold the nozzle attachment fixation element and the funnel element together, the frame connector further being configured to form a plurality of openings between the fluid outlet and the funnel element, such that the high velocity fluid stream traveling along the fluid outlet axis causes a pressure differential at the plurality of openings, thereby causing additional fluid to be drawn into the high velocity fluid stream.

2. The nozzle attachment of claim 1, wherein the nozzle attachment fixation element comprises a clamp configured to enclose a structure.

3. The nozzle attachment of claim 2 wherein the clamp is c-shaped, and the structure comprises the fluid outlet.

4. The nozzle attachment of claim 1 further comprising a fluid flow smoothing element mounted in an interior portion of the funnel element, the fluid flow smoothing element constructed and arranged for regulating a velocity distribution of a plurality of fluid particles of the high velocity fluid stream passing through the funnel element.

5. A nozzle attachment according to claim 4, wherein the fluid flow smoothing element comprises a teardrop structure having a proximal rounded portion and a distal pointed portion, the teardrop structure being mounted to an internal surface of the funnel element by a bracket and positioned in a central area of the funnel element with the distal pointed portion aligned with the fluid outlet axis.

6. A nozzle attachment according to claim 1, wherein the nozzle attachment further comprises at least one air foil mounted in an interior portion of the funnel element, the at least one air foil being constructed and arranged for controlling the direction of flow of a fluid passing through the funnel element.

7. A nozzle attachment according to claim 6, wherein the at least one air foil is configured to cause a fluid flowing through the funnel element to rotate and from a vortex flow.

8. A nozzle attachment according to claim 6, wherein the at least one air foil comprises a plurality of air foils.

9. A method for increasing the output capacity of a fluid outlet, comprising the steps of:

providing the nozzle attachment of claim 1; and installing the nozzle attachment to a fluid outlet.

10. The method of claim 9 wherein the fluid outlet comprises a leaf blower fluid outlet.

11. The method of claim 9 wherein the fluid outlet is a part of a motor, a drive or a thruster of a marine vehicle.

12. The method of claim 11 wherein the fluid outlet is a part of an outboard motor.

13. The method of claim 11 wherein the fluid outlet is a part of a water jet drive.

14. The method of claim 11 wherein the fluid outlet is a part of a bow thruster.

15. The method of claim 9 wherein the fluid outlet comprises a fluid outlet of a fan directed into a ventilation airway.

16. The method of claim 15 wherein the fluid outlet is constructed and arranged to improve ventilation flow of the fan.

17. The method of claim 15 wherein the fluid outlet is constructed and arranged to provide outside ventilation air for an air handling unit in a building.

18. The method of claim 9 wherein the fluid outlet is a part of a marine salvage "mailbox".

19. The method of claim 9 wherein the fluid outlet is a part of an open loop concentrated solar panel (CSP) desalination or water purification system and the fluid outlet is constructed and arranged to provide condensing of steam.

20. The method of claim 9 wherein the fluid outlet is used for drying cars.

* * * * *